US005662131A

United States Patent [19]

Scarborough et al.

[11] Patent Number: 5,662,131

[45] Date of Patent: Sep. 2, 1997

[54] PORTABLE FOLDING GRAB BAR

[76] Inventors: Walter M. Scarborough, 6230 Florida Blvd., Baton Rouge, La. 70806; Gary P. Allement, Sr., 15776 Russell La., Glynn, La. 70736

[21] Appl. No.: 760,715

[22] Filed: Dec. 5, 1996

[51] Int. Cl.[6] ..... A45B 1/00

[52] U.S. Cl. ..... 135/65; 135/74; 135/66; 5/620; 5/83.1

[58] Field of Search ..... 135/65, 66, 67, 135/72, 69, 75, 74; 5/620, 83.1, 86.1

[56] References Cited

U.S. PATENT DOCUMENTS

| | | | |
|---|---|---|---|
| 2,757,388 | 8/1956 | Chisholm | 135/65 X |
| 4,253,478 | 3/1981 | Husa | 135/74 X |
| 4,361,916 | 12/1982 | McDaniel | 5/620 X |
| 5,007,618 | 4/1991 | Libby | 135/65 X |
| 5,188,138 | 2/1993 | Yamasaki et al. | 135/74 X |
| 5,226,439 | 7/1993 | O'Keeffe et al. | 135/66 |
| 5,295,498 | 3/1994 | van Meter et al. | 135/65 |
| 5,305,773 | 4/1994 | Browning | 135/65 X |
| 5,449,013 | 9/1995 | Landers | 135/74 X |
| 5,509,432 | 4/1996 | Peterson | 135/65 |

*Primary Examiner*—Lanna Mai
*Attorney, Agent, or Firm*—Steven Brett Davis

[57] ABSTRACT

A portable folding grab bar device for aiding a person to stand from a seated position having four primary components, a base, a support column which pivots with respect to the base, a pivot mechanism, and a handle which the user grabs to rise from a seated position. The support column pivots with respect to the base to enhance portability. The base is designed for the user to stand upon while the handle is grasped, thus the users own body weight is used to stabilize the device in use. The device is constructed from lightweight materials to further enhance portability. The pivot mechanism is designed to prevent over rotation of the support column and to remain rigid and stable after extended use. The pivot mechanism includes a sliding locking block and is inexpensive to manufacture. The handle has a variable extension member so the height of the handle from the base may be varied to suit the users height or reach.

15 Claims, 6 Drawing Sheets

PORTABLE FOLDING GRAB BAR

TECHNICAL FIELD

The present invention relates to devices to aid people in rising to a standing position, and more particularly to a portable standing aid in which the users own weight is used to balance the device in use.

BACKGROUND ART

There are many people who as a result of accidents or infirmities are unable to rise from a sitting position without help. This may be the result of surgery to the back or abdomen, general weakness in the legs used for standing or other reasons. There are numerous devices in the prior art for assisting people with various disabilities to stand, however they are deficient with regard to their portability keeping in mind the intended users stated disabilities. In addition the prior art devices are not easily transportable and pose difficulties with regard to transportation on public carriers and automobiles which the intended users are often reliant upon. The portability desired may not be obtained at the expense of stability, as the infirm require a high degree of stability to prevent further injury. Therefore, it would be a benefit to have a standing aid which is portable and compact for traveling which at the same time retains stability and rigidity after repeated use.

GENERAL SUMMARY DISCUSSION OF INVENTION

It is thus an object of the invention to provide a portable folding grab bar to aid a person to stand from a seated or prone position.

It is a further object of the invention to provide a folding grab bar which is lightweight and portable.

It is a still further object of the invention to provide a folding grab bar which is stabilized by the users body weight, and will not tip over in use.

It is a still further object of the invention to provide a folding grab bar which remains rigid after extended use by the integration of a beveled locking block into a pivot assembly such that repeated use of the pivot mechanism does not compromise the rigidity of the device.

It is a still further object of the invention to provide a device which is cost efficient to manufacture due to consistent part dimensions and therefore inexpensive to anticipated users who are often cost constrained due to their infirmities.

Accordingly, a portable folding grab bar device for aiding a person to stand from a seated position having four primary components, a base, a tubular support column which pivots with respect to the base, a pivot mechanism, and a handle which the user grabs to rise from a seated position.

The base has a standing platform with a planer surface for the user to place his or her feet upon while he or she pulls himself or herself to a standing position. The user places his feet upon the platform and in so doing balances the device with his or her own body weight. Preferably the platform has an anti slip tread pattern embossed or stamped on its standing surface. Carpet or similar material could also be used to enhance traction. The base includes a pair of parallel extension members having a top and bottom surface. The extension members project from the platform opposite from where the support column is attached thereto and serve to increase stability of the device. The extension members are designed such that they may be inserted beneath a chair or sofa to aid in stability with the device in use. The extension members also serve as a means to secure the support column and handle when the device is transported or stored in a space saving mode. The portable folding grab bar is designed so that in use the support column may be pivoted from a first predetermined operational position perpendicular to the base to a second predetermined transport position such that the handle contacts the bottom surface of the extension members. Thus the handle serves the dual purpose of securing the support column in the transport position, as well as the primary purpose of providing a comfortable surface for the user to grasp to provide leverage to rise from a seated position.

The support column is of rectangular cross section and is formed by two pair of parallel sides which form a cavity. Preferably the support column is made of a lightweight yet rigid material such as aluminum. The support column has a vertical axis running from its upper to lower section. The lower section of the support column is attached to the base by a pivot mechanism such that it may pivot from a first predetermined operational position substantially perpendicular to the base to a second predetermined transport position. The support column is allowed to pivot beyond ninety degrees or parallel to the base such that the handle assembly attached to the upper section of the support column engages the extension member bottom surface.

The pivot mechanism includes a first lower tubular member of rectangular cross section perpendicularly attached to the base such that the first lower tubular member projects vertically from the standing platform of the base. The pivot mechanism further includes two substantially parallel pivot plates, and a locking means for selectively retaining the support column in the first predetermined operational position. The first lower tubular member is formed by two pair of parallel sides which form a cavity for receiving the locking mechanism when the support column is in the first predetermined operational position and is of similar cross sectional dimension as the support column. Preferably, the support column, the pivot mechanism lower tubular member, and the base extension members all have equal cross sectional dimensions and are made of similar lightweight aluminum. This reduces manufacturing cost and therefore retail sales price.

The pivot plates each have an upper and lower end section and are substantially rectangular in shape having a vertical axis running from the upper to lower end section. Each pivot plate is attached at its upper end section to the support column such that the vertical axis of the pivot plate is in alignment with the vertical axis running from the upper and lower sections of the support column. The pivot plate lower end section is rotatably attached to the lower tubular member by a bolt or similar fastener passing through both pivot plates and lower tubular member.

The locking mechanism includes a slidable locking block and a locking block adjustment bolt. The slidable locking block has a rectangular cross section similar to the support column but is smaller so that it may slide within the internal cavity of the support column. The locking block dimensions are such that it fits snugly within the support column but at the same time it will slide easily within. Preferably the locking block is made from plastic with smooth sides to reduce friction as it slides within the support column and into the lower tubular member of the pivot mechanism in use. More preferably the slidable locking block has a beveled edge on its lower end such that the locking block will not hang up or gall on the lower tubular member sides as the locking block slides into the cavity formed by the lower tubular member sides to secure the support column in the first predetermined operational position. Still more preferably the beveled edge is entirely disposed within the lower tubular member with the device in the first operating position. The slidable locking block slides within the support column, such that with the device in the second predetermined transport position, the locking block is disposed entirely within the support column while with the device in the first predetermined operational position the locking block is disposed partially within the support column and is partially disposed within the first lower tubular member of the pivot mechanism. The locking block serves to hold the support column perpendicular to the base in the first predetermined operational position.

The locking block adjustment bolt passes through a locking block adjustment bolt aperture in the support column and may be secured to the locking block in various ways. Preferably, the locking block has a threaded cavity into which the locking block adjustment bolt is received. By selectively tightening and loosening the adjustment bolt the locking block can be made to slide within the support column and project into the lower tubular member, thus allowing the user to selectively pivot the support column from the transport position to the upright position. Preferably the adjustment bolt has an oversized head such that the user may tighten or loosen the adjustment bolt by hand and thus pivot the support column without the use of additional tools.

The portable folding grab bar handle is attached to the support column opposite the pivot mechanism. The handle has a handle gripping member, and an extension member perpendicular attached to the handle gripping member which is in a telescoping relationship with the support column such that the distance between the hand gripping member and the support column may be adjusted by telescoping the extension member. The extension member is of rectangular cross section such that it may be inserted within the upper section of the support column. The extension member includes a height adjustment bolt for securing the handle at the selected height with respect to the base. In use when the user desires to transport the device the handle is first extended rom the support column. Next the support column is pivoted from the upright operational position by sliding the locking block from partially within the lower tubular member of the pivot mechanism to entirely within the support column lower section. The support column is contacted with the standing platform, and the handle retracted into the support column such that the handle gripping member contacts the bottom surface of the base extension members.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
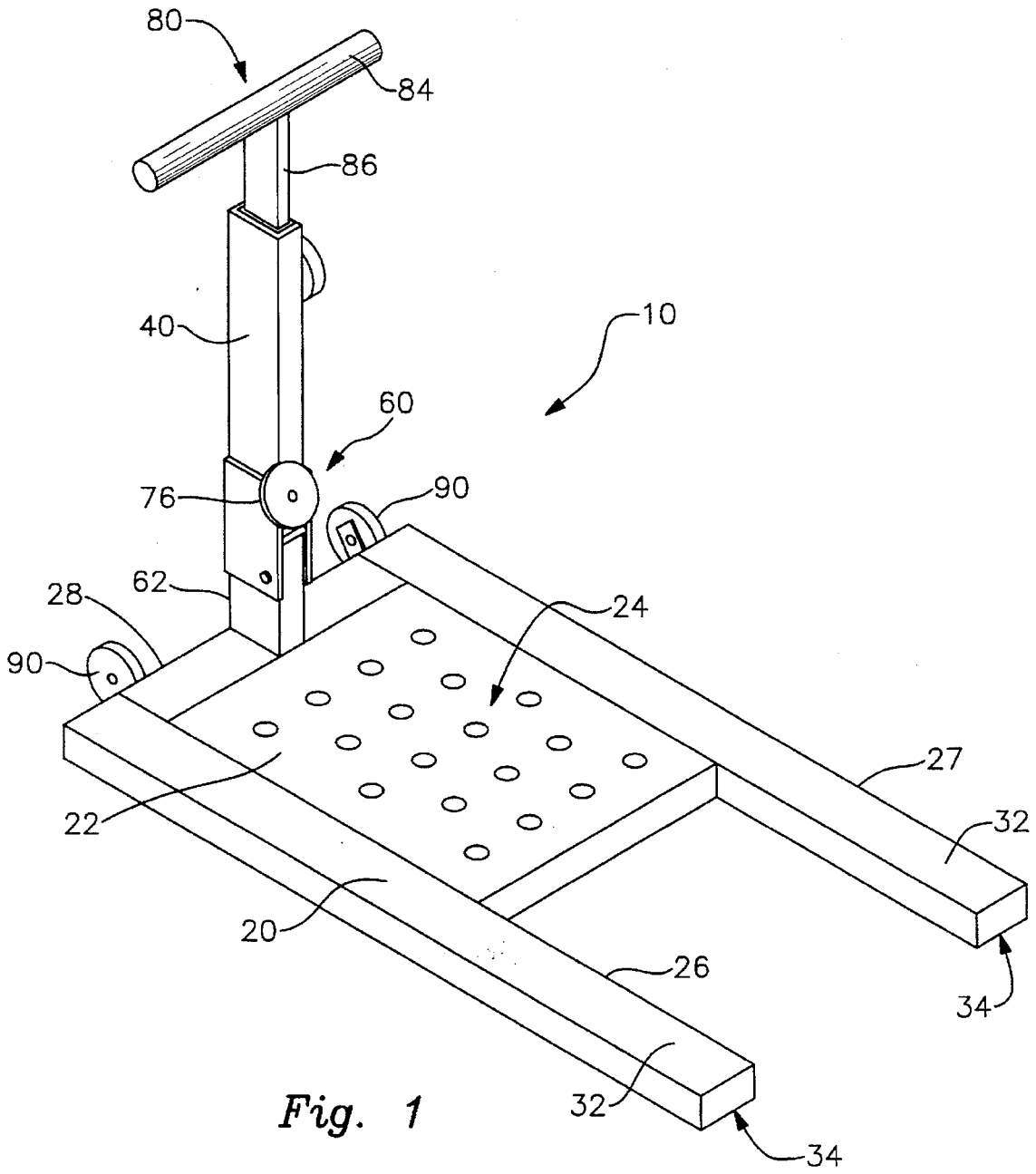
FIG. 1 is a perspective view of an exemplary embodiment of the portable folding grab bar.

Referring to the drawings, FIG. 1 depicts an exemplary embodiment of the portable folding grab bar device, generally referenced by the number 10. Device 10 has four primary components, base 20, support column 40 which pivots with respect to base 20, pivot mechanism 60, and handle 80 which the user grabs to rise from a seated position.

Figure 2:
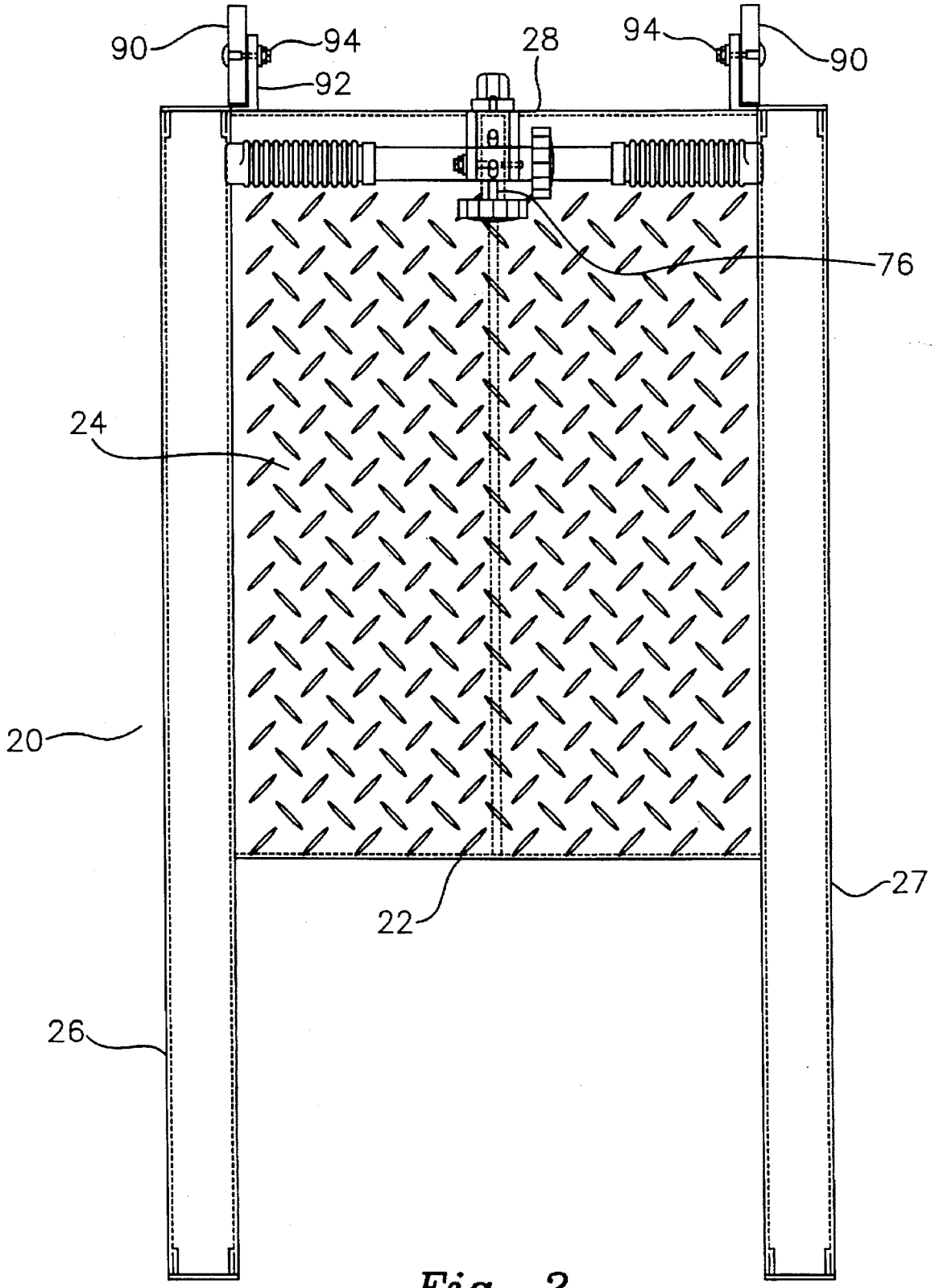
FIG. 2 is a top view of the exemplary embodiment of the portable folding grab bar device.

Referring to FIG. 2, Base 20 includes two parallel tubular aluminum base extension members 26 and 27 each having a rectangular cross section approximately 2 inches wide by 1 inch high. Base 20 includes pivot mechanism attaching member 28. Pivot mechanism attaching member 28 is constructed of tubular aluminum having same cross sectional dimension as tubular extension members 26 and 27. Parallel tubular base members 26 and 27 are welded at right angles to opposing ends of pivot mechanism attaching member 28 to form the shape of a U. Base 20 includes standing platform 22 having planer rectangular standing surface 24. Standing platform 22 is welded to tubular base extension members 26 and 27, and pivot mechanism attaching member 28. Tubular base extension members 26 and 27 project beyond standing platform 22 opposite pivot mechanism attaching member 28. Standing platform 22 has an anti-slip tread pattern embossed or stamped on standing surface 24. Parallel tubular base extension members 26 and 27 each have top surface 32 and bottom surface 34.

Figure 3:
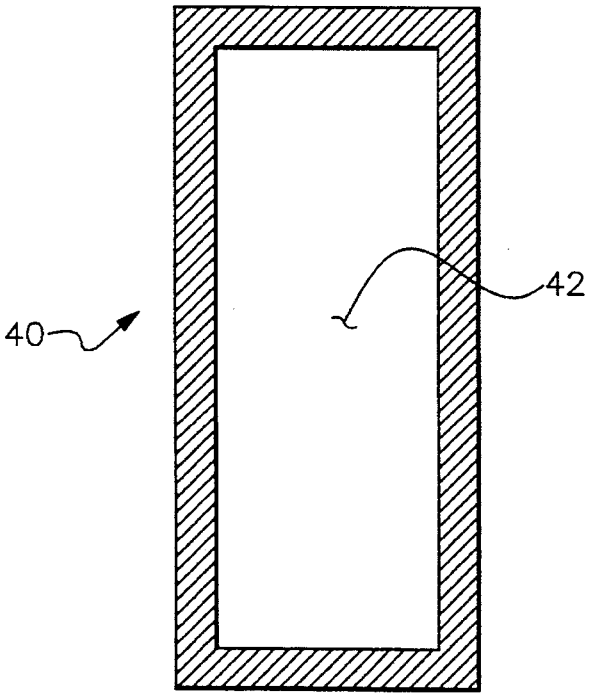
FIG. 3 is a cross sectional view of the support column of an exemplary embodiment of the portable folding grab bar.
Figure 4:
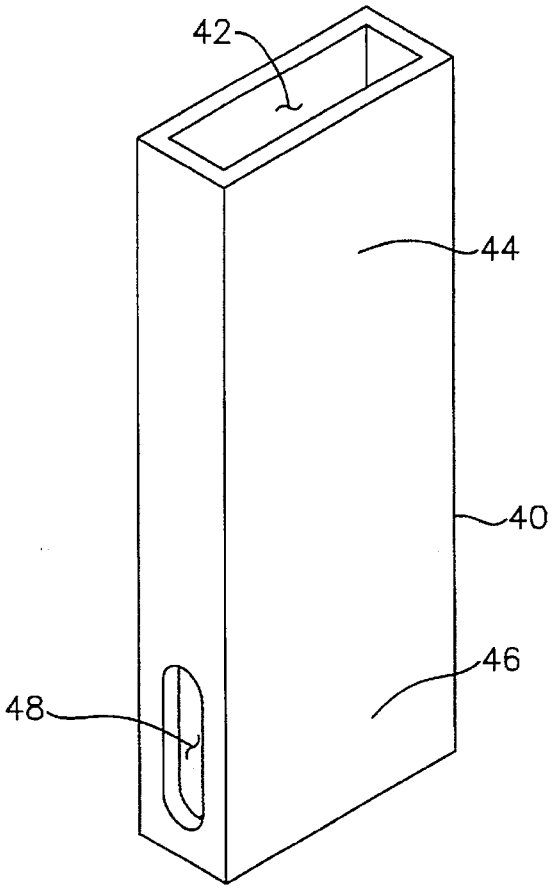
FIG. 4 is a front view of the support column of an exemplary embodiment of the portable folding grab bar.

Referring to FIG. 3, support column 40 is of rectangular cross section having an external dimension of two inches wide by one inch thick which is equal to tubular base extension members 26 and 27 external dimensions for ease of manufacturing. Referring to FIG. 4, support column 40 is formed by two pair of parallel sides which form support column cavity 42 therein. Support column 40 is constructed of lightweight rigid aluminum. Support column 40 has a vertical axis running from support column first end 44 to support column second end 46. Second end 46 of support column 40 is attached to pivot mechanism 60 (FIG. 1) such that support column 40 may pivot from a first predetermined operational position substantially perpendicular to base 20 to a second predetermined transport position.

Figure 5:
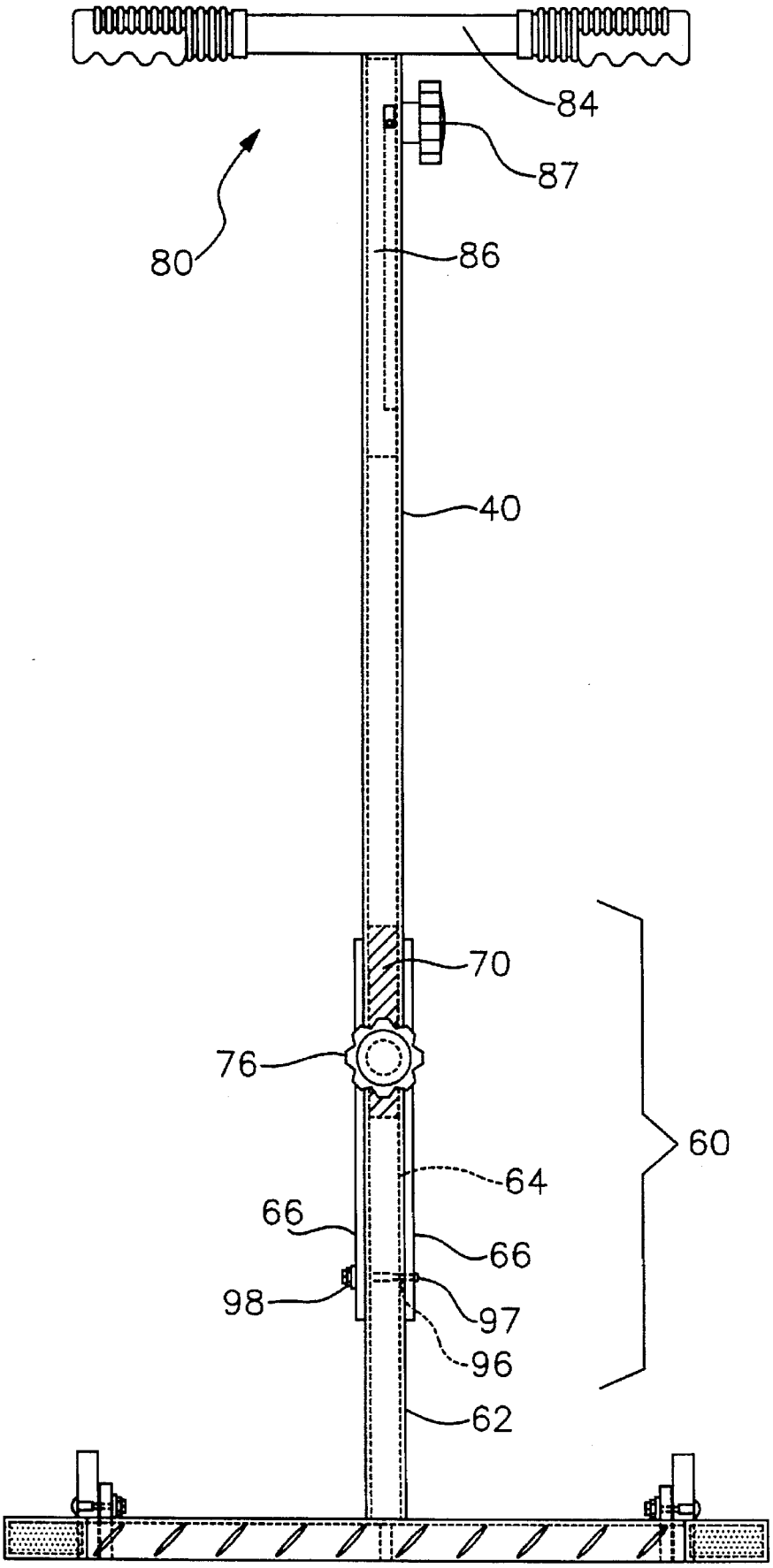
FIG. 5 is a front view of an exemplary embodiment of the portable folding grab bar.

Referring to FIGS. 1 and 5, pivot mechanism 60 includes pivot mechanism lower tubular member 62. Pivot mechanism lower tubular member 62 has rectangular cross sectional dimension and wall thickness equal to support column 40 and is welded to the center of base pivot mechanism attaching member 28 such that lower tubular member 62 projects vertically away from standing platform 22 of base 20. Lower tubular member 62 is formed by two pair of parallel sides which form slidable locking block receiving cavity 64 (hidden FIG. 5) therein and is made of rigid aluminum. Lower tubular member 62 has attachment bolt aperture 96 therethrough. Attachment bolt aperture 96 is off center of lower tubular member 62.

Pivot mechanism 60 further includes two substantially parallel pivot plates 66, and slidable locking block 70 (hidden FIG. 5) for selectively retaining support column 40 in the first predetermined operational position. Locking block receiving cavity 64 receives a portion of locking block 70 when support column 40 is in the first predetermined operational position. Locking block receiving cavity 64 has equal cross sectional dimension as support column cavity 42.

Figure 6:
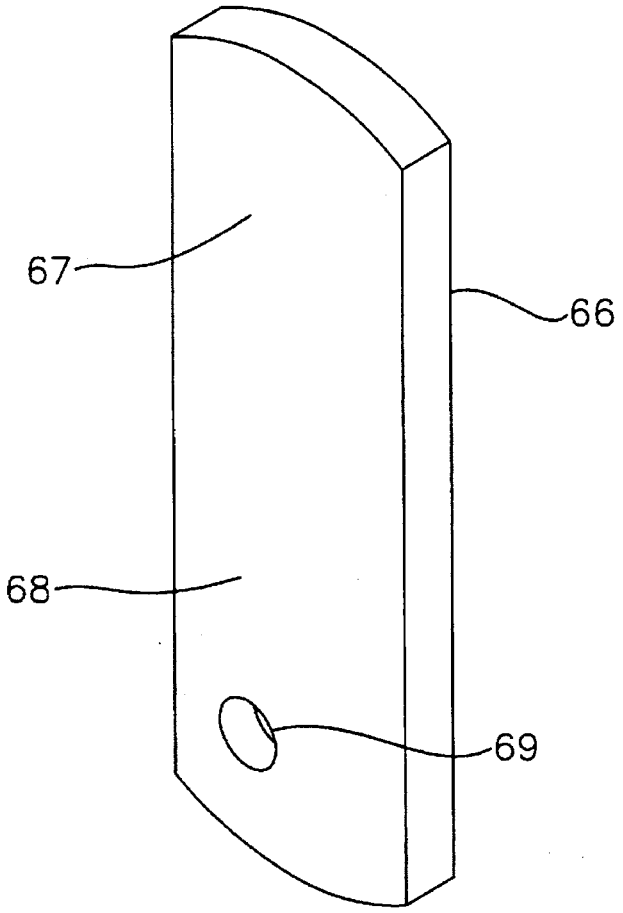
FIG. 6 is a perspective view of a pivot plate of an exemplary embodiment of the portable folding grab bar.

Referring to FIG. 6, each pivot plate 66 has upper pivot plate section 67 and lower pivot plate section 68 and are constructed of aluminum. Pivot plates 66 are rectangular in shape having a vertical axis running from upper pivot plate section 67 to lower pivot plate section 68. Upper pivot plate sections 67 are welded to opposing parallel two inch wide sides of support column second end 46 such that the vertical axis of each pivot plate 66 is parallel with the vertical axis of support column 40 running from first end 44 to second end 46. Each pivot plate lower end section 68 is rotatably attached to pivot mechanism lower tubular member 62 by attachment bolt 97 which passes through pivot plate apertures 69 and lower tubular member attachment bolt aperture 96 and is secured in place by attachment bolt locking nut 98. Pivot plate apertures 69 are off center of pivot plates 66. The off center positioning of pivot plate apertures 69 and attachment bolt aperture 96 prevent support column 40 from over pivoting beyond perpendicular to base 20. With device 10 in the first predetermined operational position support column cavity 42 and lower tubular member cavity 64 are in substantial vertical alignment and support column 40 contacts lower tubular member 62.

Figure 7:
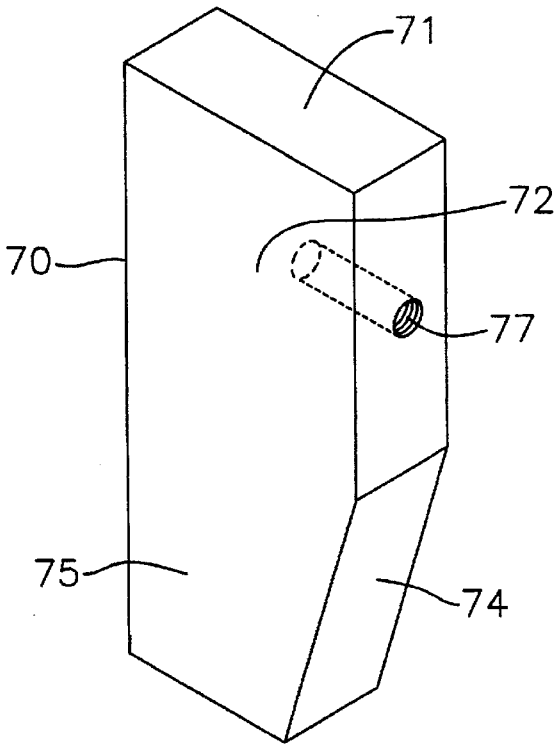
FIG. 7 is a perspective view of the locking block of an exemplary embodiment of the portable folding grab bar.

Referring to FIG. 7, slidable locking block 70 has rectangular cross section such that it may slide within support column cavity 42 and into pivot mechanism lower tubular member cavity 64. Locking block top surface 71 has dimension d such that locking block upper end 72 fits snugly within support column cavity 42 but in addition will slide easily within cavity 42. Locking block 70 is made from plastic with smooth sides to reduce friction as it slides within support column cavity 42 and into slidable locking block recessed cavity 64 of pivot mechanism 60 with the device 10 in use. Slidable locking block 70 has beveled edge 74 on locking block lower end 75 such that locking block 70 will not hang up or gall upon entering slidable locking block recessed cavity 64 of lower tubular member 62.

Locking block adjustment bolt 76 passes through support column locking block adjustment bolt aperture 48 (FIG. 4) and is secured to locking block 70 within support column cavity 42 by threading locking block adjustment bolt 76 into locking block threaded cavity 77 (FIG. 7) in a conventional fashion.

Referring to FIG. 5, portable folding grab bar handle 80 is telescopingly attached to support column 40 opposite pivot mechanism 60. Handle 80 includes handle gripping member 84 and handle extension member 86 (hidden). Handle extension member 86 is perpendicular attached to handle gripping member 84 which is in a telescoping relationship with support column 40 such that the distance between handle gripping member 84 and support column 40 may be adjusted by the user. Telescoping extension member 86 is insertable into support column recessed cavity 42 at support column first end 44. Extension member 86 is of rectangular cross section and made of aluminum. Height adjustment bolt 87 is threaded through one side of support column first end 44 and contacts extension member 86 within support column recessed cavity 42 when tightened.

Referring to FIG. 2, base 20 includes two wheels 90 attached to base 20. Wheel supports 92 are welded to and project from pivot mechanism attachment member 28 of base 20. Wheel bolts 94 secure wheels 90 to wheel supports 92. Wheels 90 are positioned such that, when extension members bottom surfaces 34 are in contact with a floor surface, wheels 90 may rotate freely and do not contact the floor surface.

Figure 8:
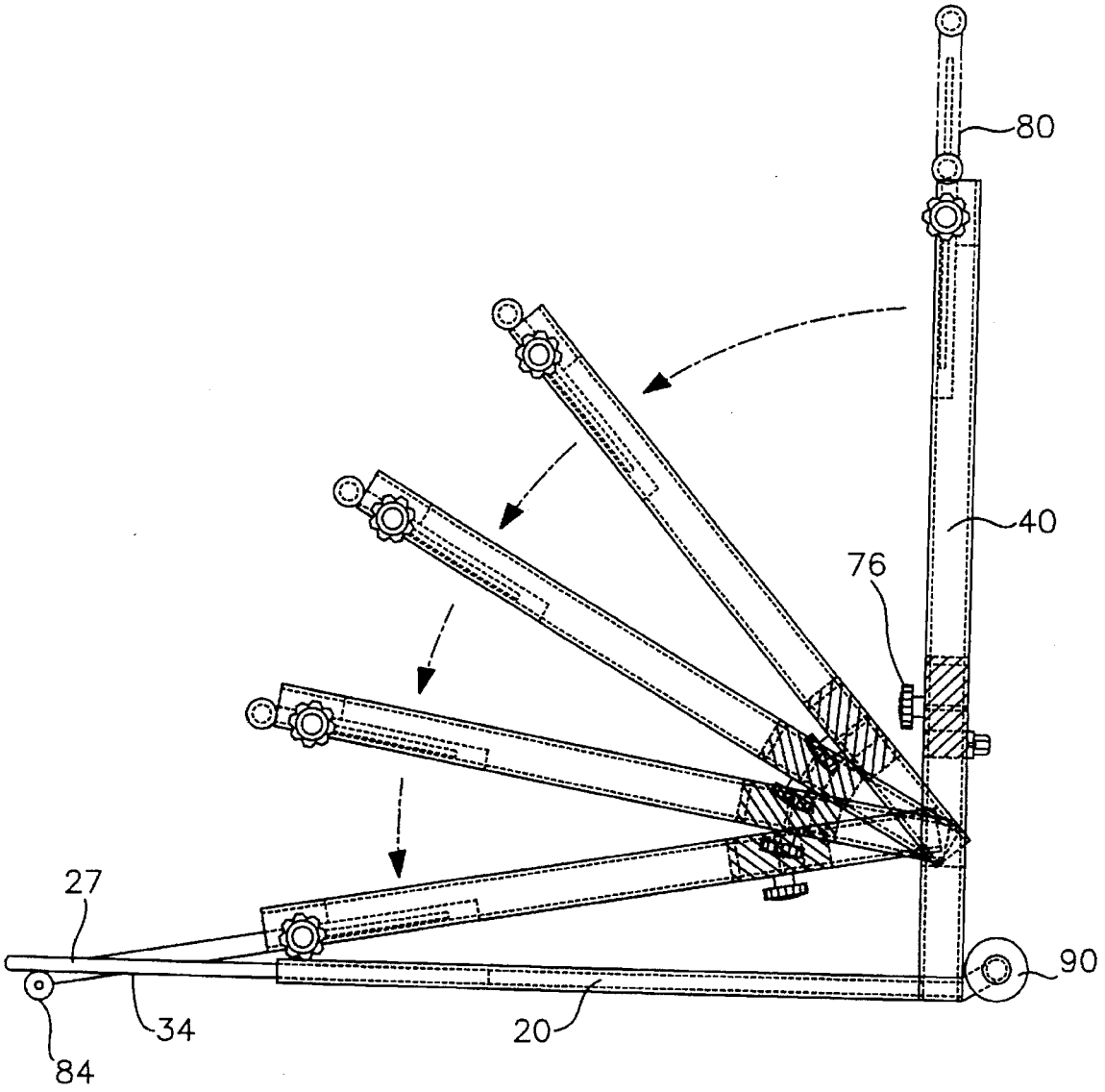
FIG. 8 is a side view of an exemplary embodiment of the portable folding grab bar in various pivoting positions.

Use of the portable folding grab bar device 10 is now described with reference to the aforementioned figures. Device 10 is positioned near a chair or sofa which user is occupying. Extension members 26 and 27 are designed such that they may be inserted beneath a chair or sofa to aid in stability with the device 10 in use. User places his feet on planer standing surface 24, grasps handle gripping member 84 and pulls himself to a standing position. FIG. 8 illustrates support column 40 pivoting from the first predetermined operational position perpendicular to base 20 to the second predetermined transport position such that handle gripping member 84 contacts base extension member bottom surface 34. To pivot the support column the user first extends handle 80 from support column 40 by loosening height adjustment bolt 87 extending extension member 86 from within support column cavity 42. Next, the user loosens locking block adjustment bolt 76 and slides slidable locking block 70 entirely into support column cavity 42 such that support column 40 may pivot downward contacting base 20. Extension members 26 and 27 are raised such that bottom surfaces 34 no longer contact the floor. Extension members 26 and 27 are raised from the floor such that wheels 90 are simultaneously brought into contact with the floor. Support column 40 is pivoted into contact with base 20. Handle 80 is retracted into support column cavity 42 such that handle gripping member 84 contacts bottom surface 34. Device 10 is rolled to where It will be next used or stored for later use.

It can be seen from the preceding description that a device for aiding a person to stand from a seated position which is lightweight and portable has been provided.

It is noted that the embodiment of the Portable folding portable grab bar described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable folding grab bar device for aiding a person to stand from a seated position comprising:

a base having a platform and a pair of parallel extension members; said platform having a planer standing surface;

a single rigid tubular support column of rectangular cross section;

a pivot means for attaching said support column to said base such that said support column pivots from a first predetermined operational position substantially perpendicular to said base to a second predetermined transport position; and a handle means attached to said support column opposite said pivot means.

2. The device of claim 1, wherein said pivot means includes a lower tubular member of rectangular cross section perpendicularly attached to said base, two substantially parallel pivot plates, and a locking means for selectively retaining said support column in said first predetermined operational position; said pivot plates rotatably attached to said lower tubular member and fixedly attached to said support column.

3. The device of claim 2 wherein said pivot plates are attached to said lower tubular member by a bolt passing through said pivot plates and lower tubular member; said bolt passing through said pivot plates and said lower tubular member off center of said pivot plates and lower tubular member.

4. The device of claim 2 wherein said handle means comprises a handle gripping member, and a handle extension member perpendicular attached to said handle gripping member in telescoping relationship with said column means such that the distance between said handle gripping member and said support column may be adjusted by telescoping said extension member.

5. The device bar of claim 2 wherein said locking means includes a slidable locking block and locking block adjustment means for securing said locking block in the first operational position; said slidable locking block slidable within said support column, such that in the second predetermined transport position said locking block is disposed entirely within said support column and in said first predetermined operational position said locking block is disposed partially within said support column and partially disposed within said lower tubular member.

6. The device of claim 5 wherein said locking block adjustment means further comprises a locking block adjustment bolt; said support column having a locking block adjustment bolt aperture therethrough; said locking block adjustment bolt passing through said locking block adjustment bolt aperture of said support column and secured to said locking block within said support column in a conventional fashion.

7. The device of claim 6 wherein said handle means comprises a handle gripping member, and a handle extension member perpendicular attached to said handle gripping member in telescoping relationship with said column means such that the distance between said handle gripping member and said support column may be adjusted by telescoping said extension member.

8. The device of claim 7 wherein said extension members have a bottom surface; said base further comprises a pair of wheels, such that in use with said extension members bottom surface in contact with a planer floor, said wheels do not contact such floor.

9. The device of claim 6 wherein said locking block has a lower end having a first beveled edge such that in said first predetermined operational position said beveled edge is disposed entirely within said first upper tubular member.

10. The device of claim 9 wherein said base further comprises a pair of wheels and said extension members have a bottom surface, said wheels fixedly attached to said base such that with said device in use with said extension member bottom surface in contact with the floor said wheels may turn free of the floor.

11. The device of claim 10 wherein said planer standing surface has a anti-slip tread pattern stamped thereon.

12. The device of claim 1 wherein said handle means comprises a handle gripping member, and a handle extension member perpendicular attached to said handle gripping member in telescoping relationship with said column means such that the distance between said handle gripping member and said support column may be adjusted by telescoping said extension member.

13. The device of claim 1 wherein said extension members have a bottom surface; said base further comprises a pair of wheels such that in use with said extension members bottom surface in contact with a planer floor, said wheels are not in contact with the floor.

14. The device of claim 13 wherein said planer standing surface has an anti-slip tread pattern stamped thereon.

15. A portable folding grab bar device for aiding a person to stand from a seated position comprising:

a base having a platform and a pair of parallel extension members; said platform having a planer standing surface; said base further comprising a pair of wheels and said extension members have a bottom surface; said wheels fixedly attached to said base such that with said device in use with said extension member bottom surface in contact with the floor said wheels may turn free of the floor;

a single rigid tubular support column of rectangular cross section;

a pivot means for attaching said support column to said base such that said support column pivots from a first predetermined operational position substantially perpendicular to said base to a second predetermined transport position; said pivot means including a lower tubular member of rectangular cross section perpendicularly attached to said base, two substantially parallel pivot plates, and a locking means for selectively retaining said support column in said first predetermined operational position; said locking means including a slidable locking block and locking block adjustment means; said locking block adjustment means further comprising a locking block adjustment bolt; said support column having a locking block adjustment bolt aperture therethrough; said locking block adjustment bolt passing through said locking block adjustment bolt aperture of said support column and secured to said locking block within said support column in a conventional fashion for securing said locking block in the first operational position; said slidable locking block slidable within said support column, such that in the second predetermined transport position said locking block is disposed entirely within said support column and in said first predetermined operational position said locking block is disposed partially within said support column and partially disposed within said lower tubular member; said pivot plates rotatably attached to said lower tubular member and fixedly attached to said support column; and a handle means attached to said support column opposite said pivot means.

* * * * *